US009305485B2

(12) United States Patent
Hong et al.

(10) Patent No.: US 9,305,485 B2
(45) Date of Patent: Apr. 5, 2016

(54) ORGANIC LIGHT EMITTING DISPLAY AND DRIVING METHOD THEREOF

(71) Applicant: Samsung Display Co., LTD., Yongin, Gyeonggi-Do (KR)

(72) Inventors: Seung-Kyun Hong, Yongin (KR); Jeong-Il Yoo, Yongin (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 298 days.

(21) Appl. No.: 13/740,448

(22) Filed: Jan. 14, 2013

(65) Prior Publication Data

US 2014/0071113 A1 Mar. 13, 2014

(30) Foreign Application Priority Data

Sep. 10, 2012 (KR) ..... 10-2012-0100013

(51) Int. Cl.
*G09G 3/32* (2006.01)

(52) U.S. Cl.
CPC ..... *G09G 3/3208* (2013.01); *G09G 3/3233* (2013.01); *G09G 3/3291* (2013.01); *G09G 2310/0251* (2013.01); *G09G 2310/0262* (2013.01); *G09G 2330/028* (2013.01)

(58) Field of Classification Search
CPC ..... G09G 3/3233; G09G 2300/0866; G09G 3/3258
USPC ..... 345/76, 77, 212, 82, 211; 315/169.3
See application file for complete search history.

(56) References Cited

U.S. PATENT DOCUMENTS

| | | | | |
|---|---|---|---|---|
| 7,224,333 | B2 * | 5/2007 | Yamazaki et al. | 345/82 |
| 7,777,698 | B2 | 8/2010 | Takahara et al. | |
| 8,063,855 | B2 | 11/2011 | Takahara et al. | |
| 2004/0056605 | A1 | 3/2004 | Yoshida | |
| 2004/0217926 | A1 * | 11/2004 | Kato | 345/76 |
| 2006/0007212 | A1 | 1/2006 | Kimura et al. | |
| 2009/0058311 | A1 * | 3/2009 | Eom | 315/173 |
| 2011/0001733 | A1 * | 1/2011 | Kawabe | 345/204 |
| 2011/0084958 | A1 * | 4/2011 | Choi et al. | 345/213 |
| 2011/0316838 | A1 | 12/2011 | Ahn | |

FOREIGN PATENT DOCUMENTS

| | | |
|---|---|---|
| KR | 1020040027363 | 4/2004 |
| KR | 1020110038915 | 4/2011 |
| KR | 1020120001470 | 1/2012 |

* cited by examiner

*Primary Examiner* — Koosha Sharifi-Tafreshi
(74) *Attorney, Agent, or Firm* — Robert E. Bushnell, Esq.

(57) ABSTRACT

The present invention relates to a driving method of an organic light emitting display which is capable of displaying images at uniform luminance. A driving method of an organic light emitting display of an embodiment according to the present invention includes supplying a data signal to a pixel and, after the data signal is supplied, driving the pixel in a constant-voltage system during a first time period and in a constant-current system during a second time period.

13 Claims, 8 Drawing Sheets

ORGANIC LIGHT EMITTING DISPLAY AND DRIVING METHOD THEREOF

CLAIM OF PRIORITY

This application makes reference to, incorporates the same herein, and claims all benefits accruing under 35 U.S.C. §119 from an application earlier filed in the Korean Intellectual Property Office on the 10th of Sep. 2012 and there duly assigned Serial No. 10-2012-0100013.

BACKGROUND OF THE INVENTION

1. Field of the Invention

The embodiments of the present invention relate to an organic light emitting display and a driving method thereof, and more particularly to an organic light emitting display which is capable of displaying images at uniform luminance and a driving method thereof.

2. Description of the Related Art

Recently, various types of flat panel displays are under development that can reduce weight and volume, which are shortcomings of cathode ray tubes. Examples of flat panel displays include a liquid crystal display, a field emission display, a plasma display panel, and an organic light emitting display device.

Among the flat panel displays, organic light emitting displays, which display images by using organic light emitting diodes to generate light by recombination of electrons and holes, provide advantages of fast response speed with low power consumption.

Organic light emitting displays include a plurality of data lines, scan lines, and a plurality of pixels positioned at cross sections of power lines in a matrix format. Generally, pixels include organic light emitting diodes and driving transistors for controlling the amount of current flowing into organic light emitting diodes. Such pixels supply current from the driving transistor to the organic light emitting diodes according to a data signal while generating light with a certain luminance.

Herein, organic light emitting diodes (OLEDs) deteriorate in proportion to the usage time. As organic light emitting diodes (OLEDs) deteriorate, a problem occurs in that desired images are not displayed due to the efficiency change. In particular, since the deterioration degree of organic light emitting diodes in each of the pixels differs according to the usage time of each of the pixels, images are displayed with non-uniform luminance.

SUMMARY OF THE INVENTION

Under the circumstances, an objective of an embodiment according to the present invention is to provide an organic light emitting display capable of displaying images with uniform luminance and a driving method thereof.

The driving method of an organic light emitting display of an embodiment according to the present invention includes supplying a data signal to a pixel; and after the data signal is supplied, driving the pixel in a constant-voltage system during a first time period and in a constant-current system during a second time period.

Preferably, the second time period is set to be wider than the first time period. Each of the pixels includes is driving transistor that controls current flowing from a first power source to a second power source through an organic light emitting diode, and is driven in a linear region during the first time period and the driving transistor is driven in a saturation region during the second time period. A second power source at a second voltage is supplied during the first time period, and the second power source at the second voltage is supplied during the second time period. The second voltage is set to be higher than the first voltage.

The organic light emitting display of an embodiment according to the present invention includes a scan driving unit for driving scan lines; a data driving unit for driving data lines; pixels positioned at cross sections of the scan lines and the data lines, and controlling the amount of current flowing from a first power source to a second power source through an organic light emitting diode; and a power supply that generates the first power source and the second power source; wherein each of the pixels is driven in a constant-voltage system during a first time period of a frame, and is driven in a constant-current system during a second time period of the frame.

Preferably, the second time period is set to be wider than the first time period. In order to control the amount of current, each of the pixels includes a driving transistor, and the driving transistor is driven in a linear region during the first time period while the driving transistor is driven in a saturation region during the second time period. The power supply supplies a second power source at a second voltage during the first time period and supplies the second power source at a first voltage during the second time period in response to an external control signal. The second voltage is set to be higher than the first voltage.

The power supply commonly supplies the second power source to the pixels. The power supply supplies the second power source to the pixels by horizontal lines. The power supply includes an output unit to output the second power source at the second voltage or at the first voltage in response to a control signal. The power supply further includes an inverter unit that amplifies the control signal to be delivered to the output unit. After the data signal is supplied to each of the pixels, the pixels are driven in the constant-voltage and constant-current system.

According to the organic light emitting display and the driving method thereof of an embodiment according to the present invention, each of the pixels is driven in a constant-voltage and constant-current system during a frame period. In this case, the deterioration degree of an organic light emitting diode included in each of the pixels becomes similar, and thereby images can be displayed at uniform luminance.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1A:
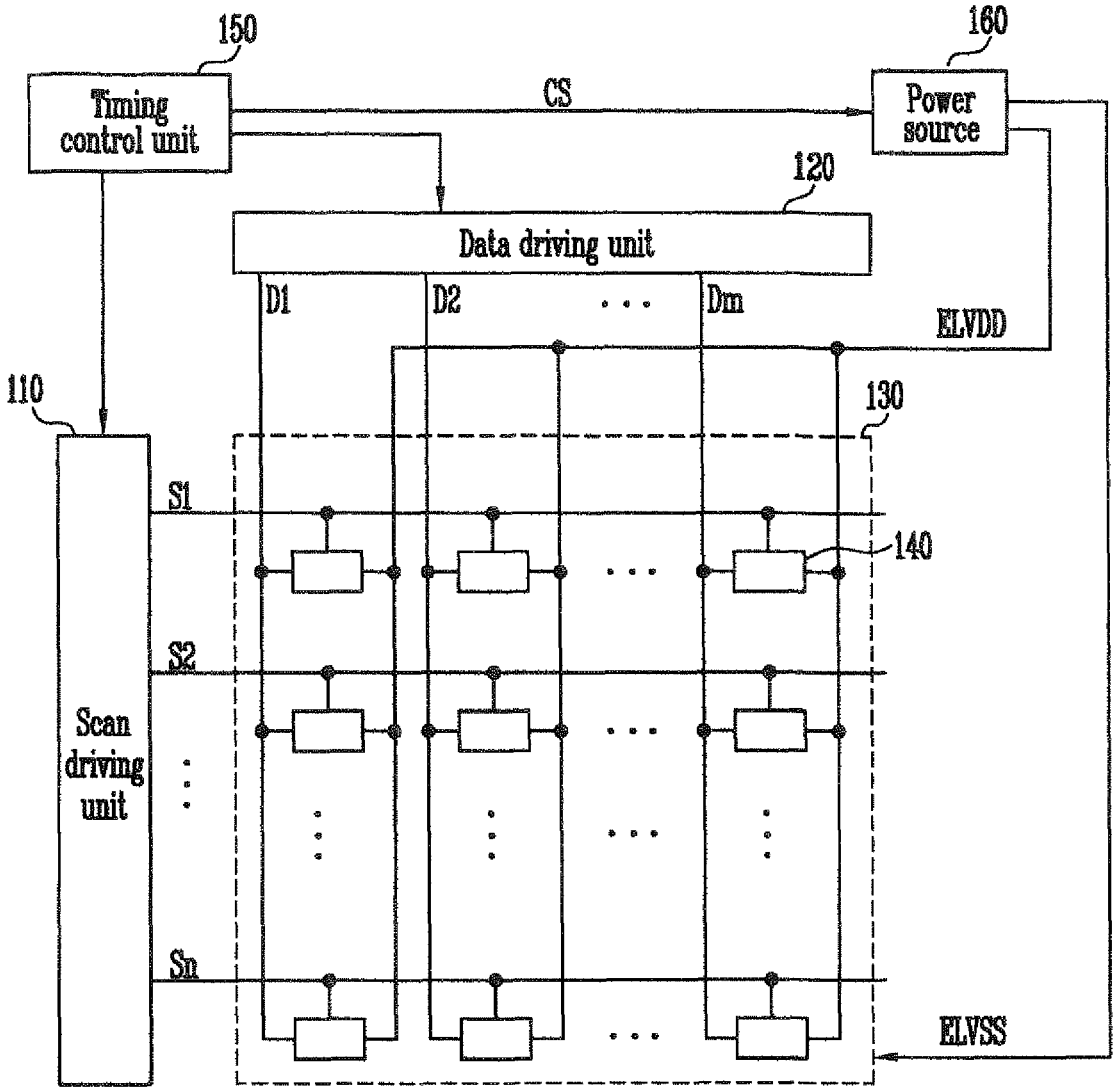
FIG. 1A is a diagram illustrating an organic light emitting display according to an embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Hereinafter, preferred embodiments which can be easily practiced by those skilled in the art will be described below with reference to FIGS. 1 to 10B attached hereto.

Figure 1B:
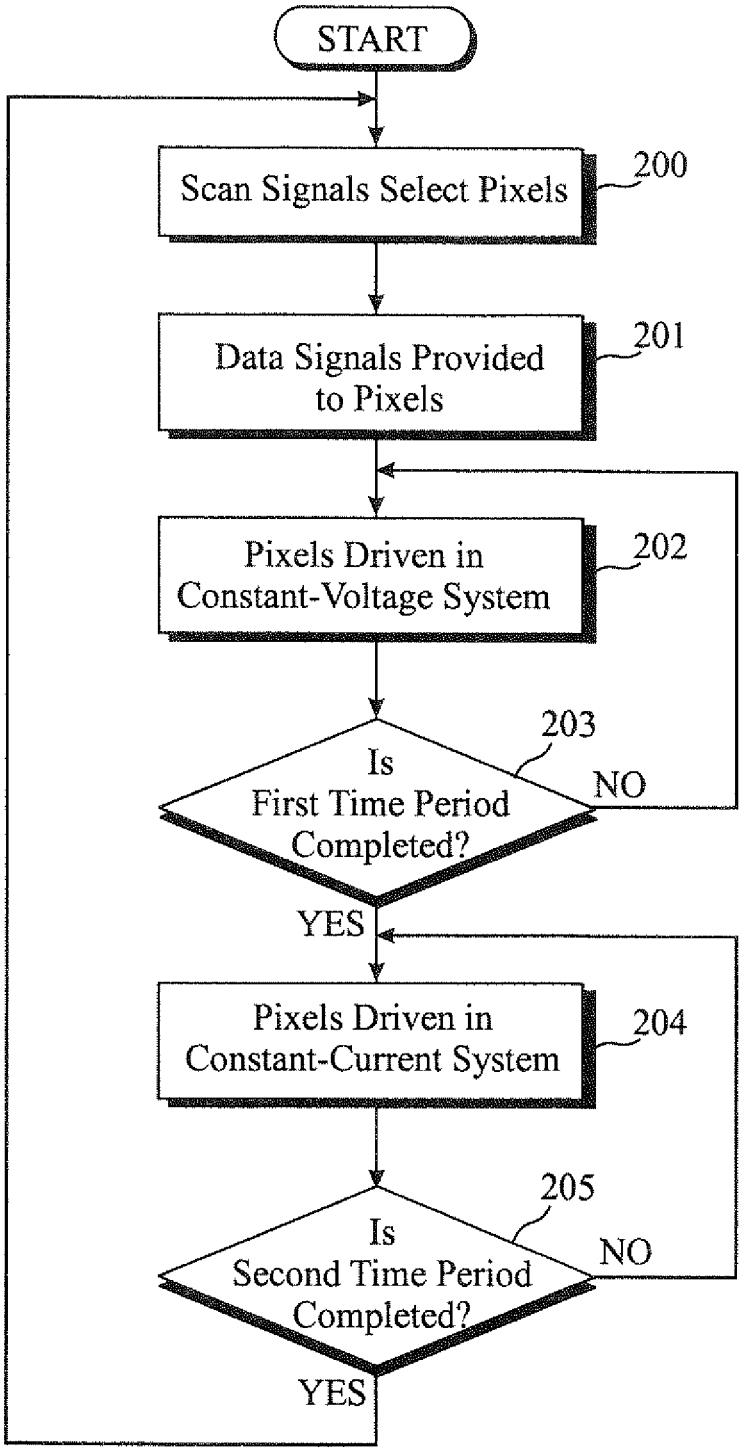
FIG. 1B is a flow chart of the method of the present invention.

FIG. 1A is a diagram illustrating an organic light emitting display according to an embodiment of the present invention, and FIG. 1B is a flow chart of the method of the present invention.

In FIG. 1A, the organic light emitting display according to an embodiment of the present invention includes a pixel region 130 having pixels 140 positioned at cross sections of to scan lines S1 to Sn and data lines D1 to Dm, a scan driving unit 110 for driving the scan lines S1 to Sn, a data driving unit 120 for driving the data lines D1 to Dm, a power source 160 for generating a first power ELVDD and to second power ELVSS, and a timing control unit 150 for controlling the scan driving unit 110, the data driving unit 120 and the power source 160.

The scan driving unit 110 generates scan signals under the control of the timing control unit 150 and sequentially provides the generated scan signals to the scan lines S1 to Sn. Herein, the scan signals are set to be a voltage that enables transistors included in the pixels 140 to be turned on (for example, a low voltage). When the scan signals are sequentially provided from the scan driving unit 110, the pixels 140 are selected by horizontal lines (FIG. 1B, block 200).

The data driving unit 120 generates data signals under the control of the timing control unit 150 and provides the generated data signals to the data lines D1 to Dm in order to be in synchronization with the scan signals. In this case, the data signals are provided to the pixels 140 selected by the scan signals (FIG. 1B, block 201).

The power source 160 supplies the first power ELVDD and the second power ELVSS to each of the pixels 140. Herein, the power source 160 controls the voltage of the second power ELVSS according to the control signal CS from the timing control unit 150. As an example, the power source 160 controls the voltage of the second power ELVSS according to the control signal CS such that the transistors included in each of the pixels 140 are driven in a linear region during the first period of a frame and the transistors included in each of the pixels 140 are driven in a saturation region during the second period other than the first period.

Although FIG. 1 illustrates that the control signal CS is supplied from the timing control unit 150, the present invention is not limited thereto. In practice, the control signal CS, which is set to be high and low voltage during the first and second period of a frame, respectively, may be generated in a separate driving unit or from the driving unit 120.

The timing control unit 150 controls the scan driving unit 110, the driving unit 120, and the power source 160. In addition, the timing control unit 150 provides the power source 160 with the control signal CS.

The pixel region 130 receives the first power ELVDD and the second power ELVSS from the power source 160 and provides them to each of the pixels 140. Herein, the driving transistors included in each of the pixels 130 are driven in a constant-voltage or constant-current system according to the second power ELVSS.

Specifically, the pixels 130 are driven in the constant-voltage system during the first period in which the driving transistors are driven in the linear region (FIG. 1B, blocks 202 and 203), and the pixels 130 are driven in the constant-current system during the second period in which the driving transistors are driven in the saturation region (FIG. 1B, blocks 204 and 205). When the pixels 130 are driven in the constant-current system, the driving transistors are driven as constant-current sources that control the amount of the current supplied to the organic light emitting diode according to the data signals. Therefore, the pixels 130 control the amount of the current supplied to the organic light emitting diode according to the data signal during the second period, and thereby light is generated from the organic light emitting diode according to the data signals. When the pixels 130 are driven in the constant-voltage system, the driving transistors are driven as certain voltage sources.

Although FIG. 1A illustrates that each of the pixels 140 is connected to one scan line S and one data line D for simplicity, the present invention is not limited thereto. For example, each of the pixels 140 may be further connected to a light emitting control line (not illustrated) in addition to the scan line S. In practice, the pixels 140 according to the present invention may be implemented with various configurations known in the art.

Figure 2:
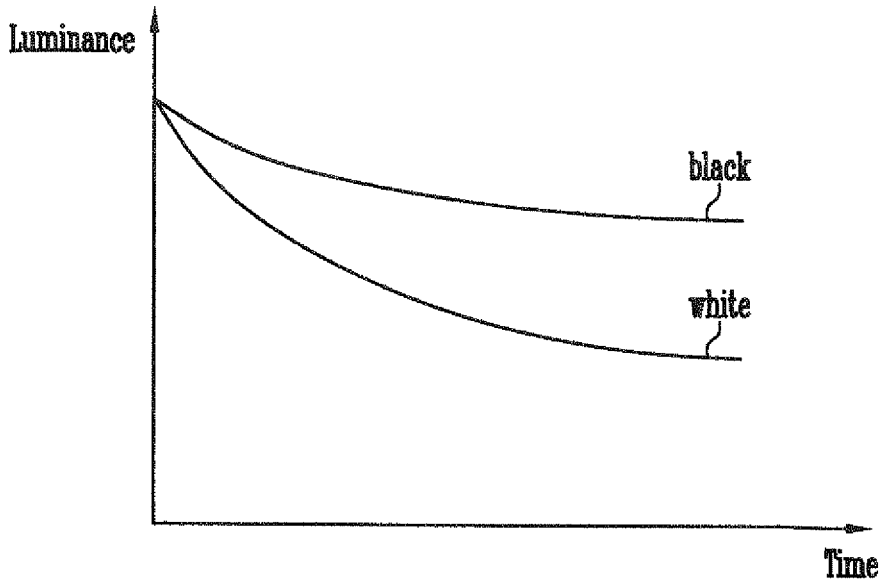
FIG. 2 is a graph illustrating the deterioration characteristic of an organic light emitting diode when pixels are driven in a constant-current system.

FIG. 2 is a graph illustrating the deterioration characteristic of an organic light emitting diode when pixels are driven in a constant-current system.

Referring to FIG. 2, in the constant-current system, an organic light emitting diode (OLED) deteriorates more when implementing black luminance than when implementing white luminance. As such, when the deterioration degree of the organic light emitting diode (OLED) differs in the pixels 140, light at different luminance is generated according to the same data signal. That is, a problem occurs in that non-uniform images are displayed in the pixel region 130 according to the deterioration of the organic light emitting diode (OLED). In particular, unevenness of the images is more serious when black luminance is implemented in a certain region of the pixel region 130 and white luminance is implemented in the other regions for a given time period.

Figure 3:
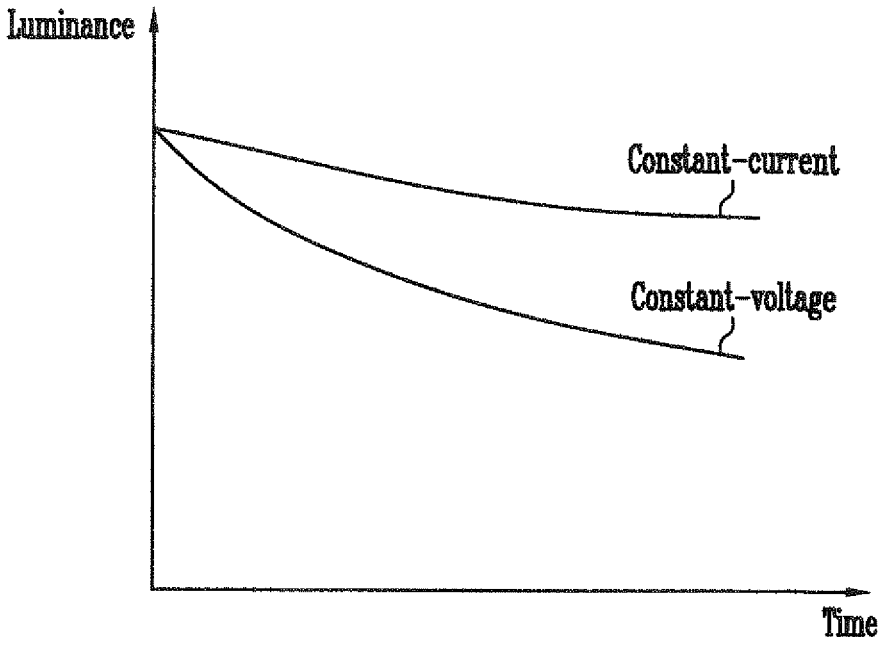
FIG. 3 is a graph illustrating the deterioration characteristic of an organic light emitting diode when pixels are driven in a constant-current and constant-voltage system.

FIG. 3 is a graph illustrating the deterioration characteristic of an organic light emitting diode when pixels are driven in a constant-current and constant-voltage system.

Referring to FIG. 3, current is supplied to an anode electrode of an organic light emitting diode (OLED) in the constant-current system, and voltage is applied to the anode electrode of the organic light emitting diode (OLED) in the constant-voltage system. Accordingly, the organic light emitting diode (OLED) deteriorates more rapidly when being implemented in a constant-voltage system than in a constant-current system.

Further, empirically, when pixels 140 are driven in a constant-voltage system, an organic light emitting diode (OLED) deteriorates more rapidly when implementing black luminance than white luminance. This is because carriers injected into the anode electrode of the organic light emitting diode are not controlled when black luminance is implemented in a constant-voltage system, so that the interface of the organic light emitting diode (OLED) is damaged by the carriers which fail to recombine.

In conclusion, an organic light emitting diode (OLED) deteriorates rapidly when implementing white luminance in a constant-current system, and the organic light emitting diode (OLED) deteriorates rapidly when implementing black luminance in a constant-voltage system. That is, in a constant-current system and constant-voltage system, the deterioration characteristic of an organic light emitting diode (OLED) is opposite depending on the luminance implemented. Further, an organic light emitting diode (OLED) deteriorates more rapidly when driven by constant-voltage than by constant-current. The present invention utilizes such characteristic such that the deterioration degree of an organic light emitting diode (OLED) can be maintained substantially the same in the pixel region 130 by driving each of the pixels 140 in one frame period in a constant-current and constant-voltage system. The detailed description thereon will be made below.

Figure 4:
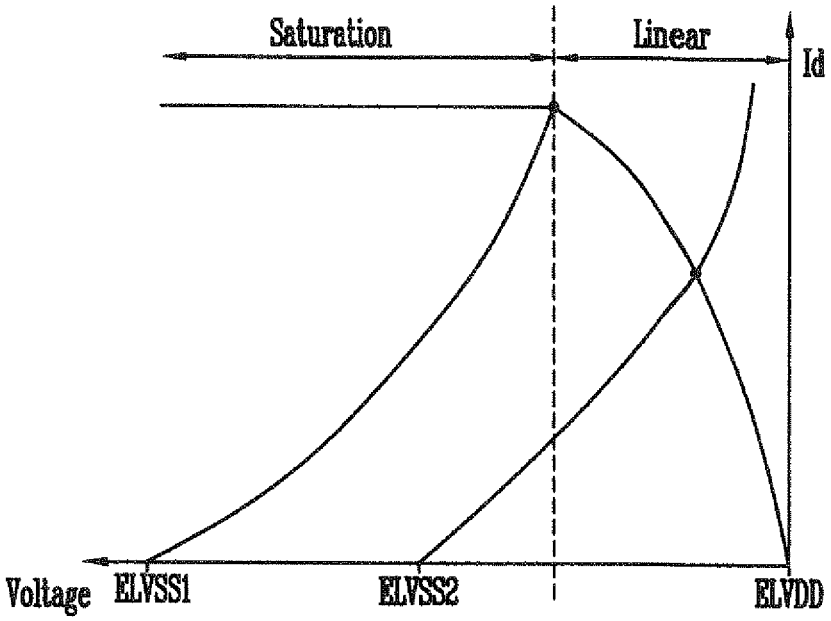
FIG. 4 is a diagram illustrating a driving region of a driving transistor according to the voltage of the second power source.

FIG. 4 is a diagram illustrating a driving region of a driving transistor according to the voltage of the second power source.

Referring to FIG. 4, when the second power ELVSS is set to first voltage ELVSS1, driving transistors included in each of the pixels 140 are driven in the saturation region. When the driving transistors are driven in a saturation region, the pixels 130 are driven in a constant-current system. Further, when the second power ELVSS is set to second voltage ELVSS2, the driving transistors included in each of the pixels 140 are driven in the linear region. When the driving transistors are driven in the linear region, the pixels 130 are driven in a constant-voltage system.

That is, the present invention uses the second power ELVSS so that the pixels 130 are controlled to be driven in a constant-current or constant-voltage system.

Figure 5:
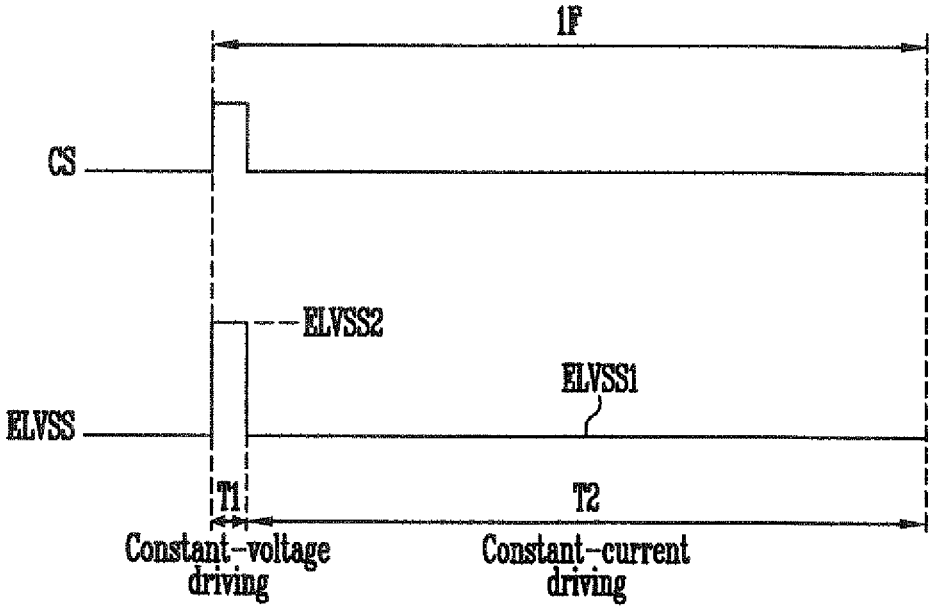
FIG. 5 illustrates an embodiment in which pixels are driven according to a control signal.

FIG. 5 illustrates an embodiment in which pixels are driven according to a control signal. Referring to FIG. 5, the control signal CS is set to high voltage (or low voltage) during a first time period in a frame and is set to low voltage (or high voltage) during a second time period. In response to the control signal CS, the power source 160 provides the second power ELVSS set as the second voltage ELVSS2 during the first time period, and thereby the pixels 130 are driven in a constant-voltage system. Further, in response to the control signal CS, the power source 160 provides the second power ELVSS set as the first voltage ELVSS1 during the second time period, and thereby the pixels 130 are driven in a constant-current system.

Herein, the first time period T1 driven in a constant-voltage system is set to be shorter than the second time period T2 driven in a constant-current system. In other words, by setting the first time period T1 during which an organic light emitting diode (OLED) rapidly deteriorates shorter than the second time period T2, the deterioration degree of an organic light emitting diode (OLED) included in each of the pixels 140 can be maintained uniformly.

Specifically, after a data signal is supplied, each of the pixels 130 is driven in a constant-voltage system during the first time period T1, and is driven in a constant-current system during the second time period T2. In this case, organic light emitting diodes (OLEDs) included in the pixels 130 deteriorate according to a constant-voltage system during the first time period T1 and deteriorate according to a constant-current system during the second time period T2. Herein, since the deterioration characteristics of the constant-voltage system and the constant-current system are different, the deterioration degree of the organic light emitting diode (OLED) can be maintained uniformly in each of the pixels 130.

For example, it is assumed that white luminance is implemented in a first pixel and black luminance is implemented in a second pixel. The organic light emitting diode included in the first pixel mainly deteriorates during the second time period T2, and the organic light emitting diode included in the second pixel mainly deteriorates during the first time period T1. Therefore, during one frame period, the deterioration degrees of the organic light emitting diodes included in each of the first and second pixels are set substantially similar, and thereby images can be displayed at uniform luminance in the pixel region 130 regardless of the deterioration of the organic light emitting diode.

On the other hand, the present invention is characterized in that the first time period T1 and the second time period T2 are repeated after data signals are supplied to the pixels 140, and such a feature may be applied in various manners.

For example, when each of the pixels 140 simultaneously emits light, while the second power ELVSS is commonly supplied to each of the pixels 140, the first time period T1 and the second time period T2 may be repeated during a light emitting period, as illustrated in FIG. 1. In this case, the first time period T1 may be included in a porch period which is a beginning period of each frame.

Figure 6:
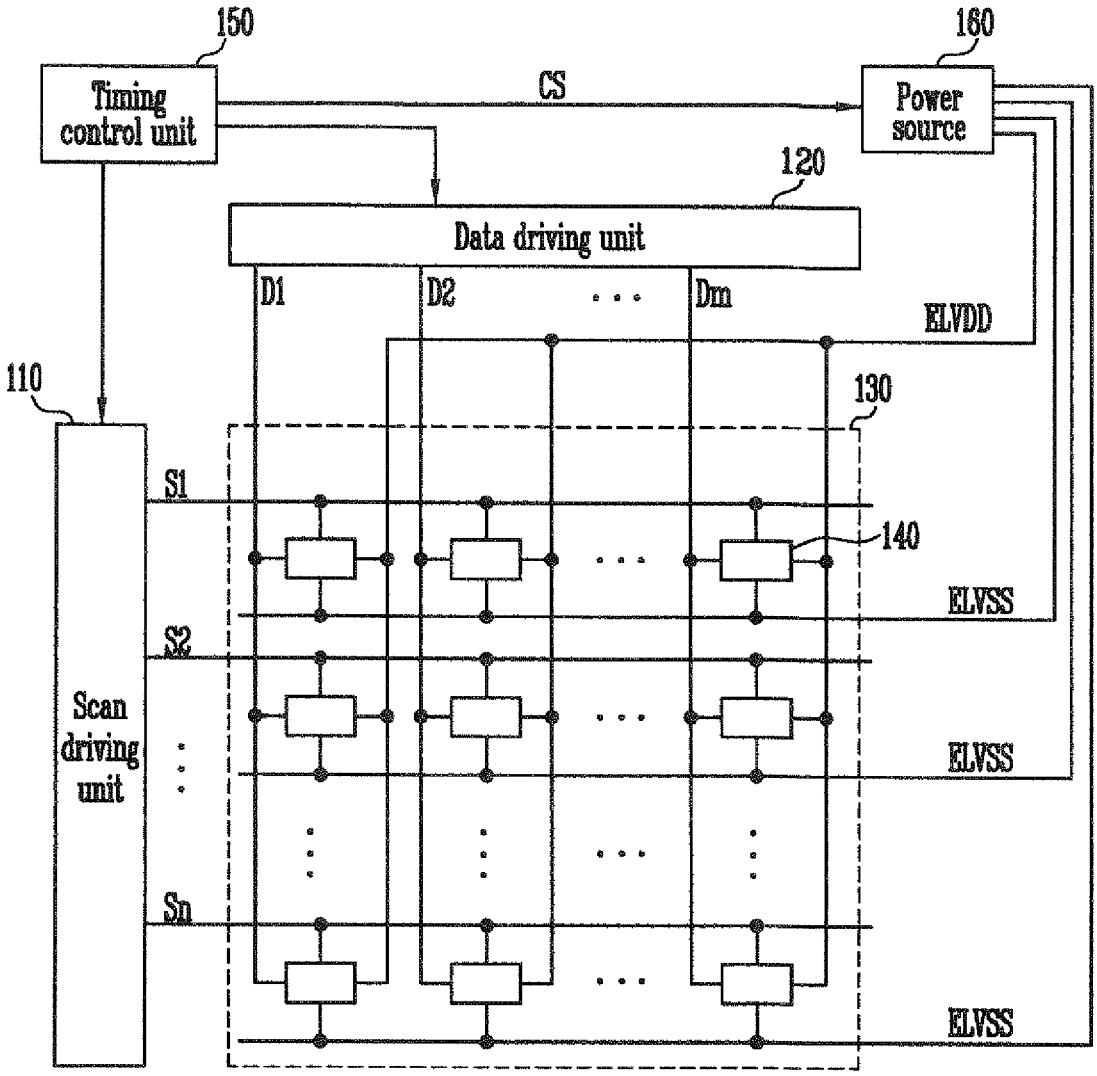
FIG. 6 is a diagram illustrating an organic light emitting display according to another embodiment of the present invention.

Further, when the pixels 140 sequentially emit light, the second power ELVSS may be supplied such that the first voltage ELVSS1 and the second voltage ELVSS2 are repeated for every other horizontal line, as illustrated in FIG. 6, which is a diagram illustrating an organic light emitting display according to another embodiment of the invention. That is, the present invention is characterized in that the pixels 140 are driven in a constant-voltage and constant-current system after data is supplied to the pixels 140, and such a feature may be applied to various driving manners. Further, even when the pixels 140 sequentially emit light, the second power ELVSS may be commonly supplied to each of the pixels 140. In this case, after a data signal has been supplied to the pixels 140, it is controlled so that the second power ELVSS has the second voltage ELVSS2. Then, each of the pixels 140 is simultaneously driven in a constant-voltage system, and is driven in constant-current system during the other period.

Additionally, in the present invention, the first time period T1 during which the pixels 140 are driven in a constant-voltage system is set to be an extremely short time period in a frame 1F. In this case, an observer may perceive an image by the luminance generated during the second time period T2, and accordingly may display a desired image with stability.

Figure 7:
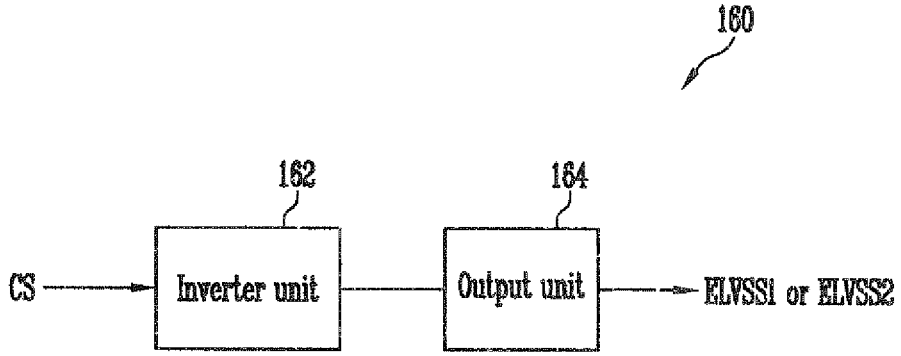
FIG. 7 is a diagram illustrating a power source section according to an embodiment of the present invention.

FIG. 7 is a diagram illustrating a power source section according to an embodiment of the present invention.

Referring to FIG. 7, the power source section of an embodiment according to the present invention has an inverter unit 162 and output unit 164. The inverter unit 162 receives a control signal CS, and inverts the received control signal CS into high or low voltage to supply to the output unit 164. In practice, the inverter unit 162 amplifies the voltage of the control signal CS so that the output unit 164 may be driven with stability according to the control signal CS. On the other hand, when it is possible to supply a control signal CS with sufficient voltage within the system of an organic light emitting display, the inverter unit 162 may be omitted.

The output unit 164 outputs a second power ELVSS having the first voltage ELVSS1 or the second voltage ELVSS2 according to the control signal CS amplified from the invert unit 162.

Figure 8:
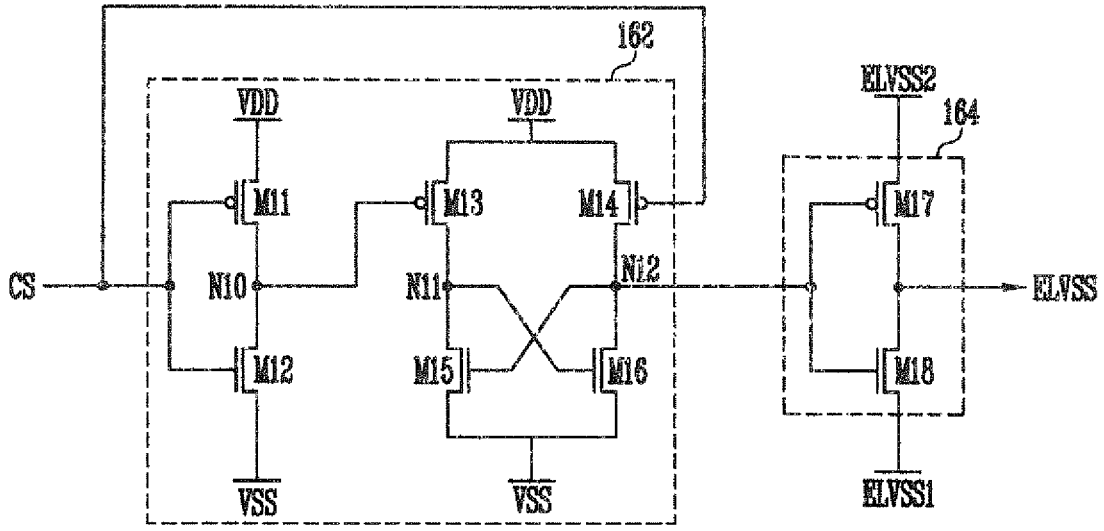
FIG. 8 is a diagram illustrating embodiments of the inverter unit and the output unit illustrated in FIG. 7.

FIG. 8 is a diagram illustrating embodiments of the inverter unit and the output unit illustrated in FIG. 7.

Referring to FIG. 8, the inverter unit 162 has an eleventh transistor M11 to a sixteenth transistor M16. The eleventh transistor M11 and a twelfth transistor M12 are serially connected between a third power source VDD and a fourth power source VSS lower than the third power source. The eleventh transistor M11 and the twelfth transistor M12 are alternately turned on and of according to the control signal CS. To achieve this, the eleventh transistor M11 is configured as PMOS while the twelfth transistor M12 is configured as NMOS.

A thirteenth transistor M13 and a fifteenth transistor M15 are serially connected between the third power source VDD and the fourth power source VSS. Herein, the thirteenth transistor M13 is turned on and off according to the voltage applied to a tenth node N10. The fifteenth transistor M15 is turned on and off according to the voltage applied to the twelfth node N12. Herein, the thirteenth transistor M13 is configured as PMOS and the fifteenth transistor M15 is configured as NMOS.

The fourteenth transistor M14 and the sixteenth transistor M16 are serially connected between the third power source VDD and the fourth power source VSS. Herein, the fourteenth transistor M14 is turned on and off according to the control signal CS. The sixteenth transistor M16 is turned on and off according to the voltage applied to the eleventh node N11. Herein, the fourteenth transistor M14 is configured as PMOS and the sixteenth transistor M16 is configured as NMOS.

In operation, firstly, the twelfth transistor M12 is turned on when the control signal CS of high voltage is supplied. When the twelfth transistor M12 is turned on, the fourth power source VSS is supplied to the tenth node N10, and at this time the thirteenth transistor M13 is turned on. When the thirteenth transistor M12 is turned on, the third power source VDD is supplied to an eleventh node N11, and at this time the sixteenth transistor M16 is turned on. When the sixteen transistor M16 is turned on, the fourth power source VSS is supplied to the twelfth node N12. That is, when the control signal CS at high voltage is supplied, the voltage of the fourth power source VSS (i.e., low voltage) is applied to the twelfth node N12.

The eleventh transistor M11 is turned on when the control signal CS at low voltage is supplied. When the eleventh transistor M11 is turned on, the third power source VDD is supplied to the tenth node N10, and at this time the thirteenth transistor M13 is turned off. At this time, since the fourteenth transistor M14 at low voltage is turned on according to the control signal CS, the third power source VDD (i.e., high voltage) is supplied to the twelfth node N12.

The output unit 164 has a seventeenth transistor M17 and an eighteenth transistor M18 which are serially connected between a power source for supplying the second voltage ELVSS2 and a power source for supplying the first voltage ELVSS1. The seventeenth transistor M17 and the eighteenth transistor M18 are alternatively turned on and off according to the voltage applied to the twelfth node N12. To achieve this, the seventeenth transistor M17 is configured as PMOS and the eighteenth transistor M18 is configured as NMOS.

In operation, firstly, the seventeenth transistor M17 is turned on when the fourth power source VSS is supplied to the twelfth node N12. When the seventeenth transistor M17 is turned on, the second power ELVSS of the second voltage ELVSS2 is outputted through an output terminal. That is, the second power ELVSS of the second voltage ELVSS2 is outputted from the power source 160 according to the control signal CS at high voltage. The eighteenth transistor M18 is turned on when the third power source VDD is supplied to the twelfth node N12. When the eighteenth transistor M18 is turned on, the second power ELVSS of the first voltage ELVSS1 is output through the output terminal. That is, the second power ELVSS of the first voltage ELVSS1 is outputted from the power source 160 according to the control signal CS at low voltage.

Figure 9:
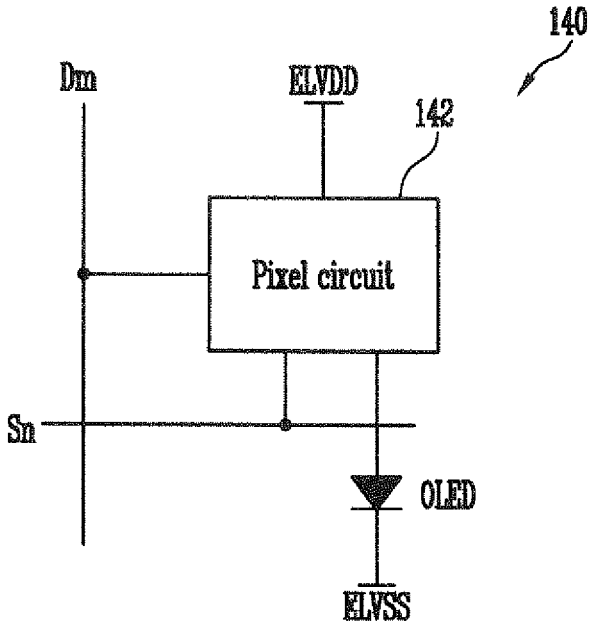
FIG. 9 is a diagram illustrating a pixel according to an embodiment of the present invention.

FIG. 9 is a diagram illustrating a pixel according to an embodiment of the present invention. FIG. 9 illustrates a pixel connected to an m-th data line (Dm) and an n-th scan line Sn, for simplicity.

Referring to FIG. 9, a pixel 140 of an embodiment according to the present invention includes an organic light emitting diode (OLED) and a pixel circuit 142 that controls the amount of current supplied to the organic light emitting diode (OLED). The anode electrode of the organic light emitting diode (OLED) is connected to the pixel circuit 142, and the cathode electrode is connected to the second power ELVSS. Such an organic light emitting diode (OLED) generates light at certain luminance according to the current supplied from the pixel circuit 142.

The pixel circuit 142 receives a data signal from the data line Dm when a scan signal is supplied to the scan line Sn. The pixel circuit 142, which has received the data signal, supplies the organic light emitting diode (OLED) with a current corresponding to the data signal. Such a pixel circuit 142 may be configured as various circuits known in the art are configured. Further, the pixel circuit 142 is driven in a constant-current or constant-voltage system according to the voltage of the second power ELVSS.

Figure 10A:
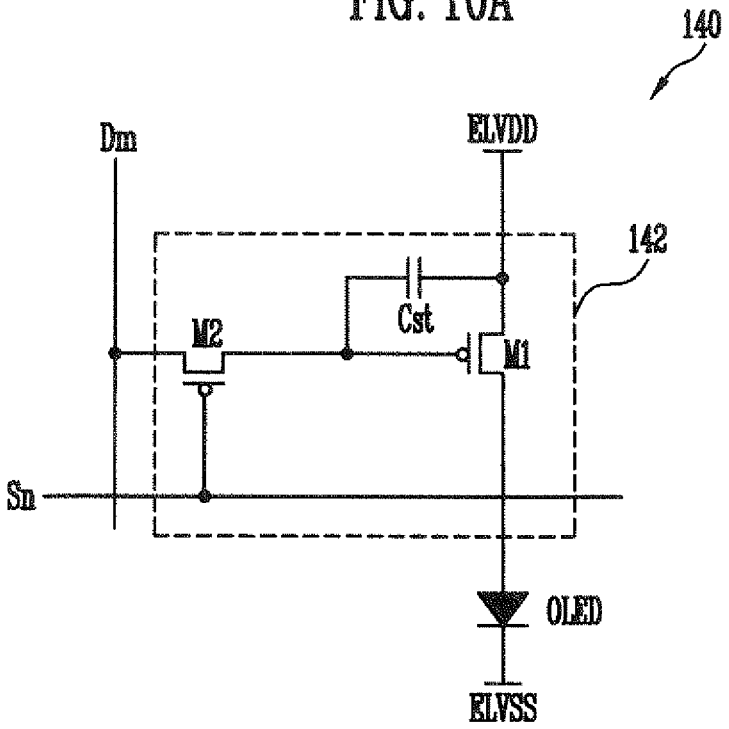
FIGS. 10A and 10B are diagrams illustrating embodiments of the pixel circuit illustrated in FIG. 9.
Figure 10B:
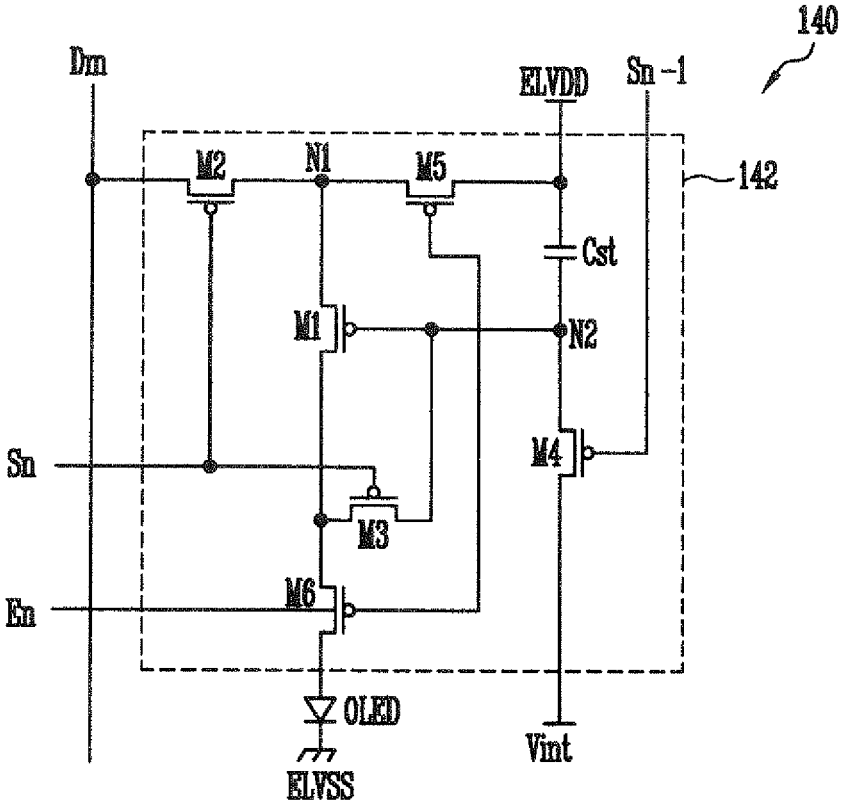

FIGS. 10A and 10B are diagrams illustrating embodiments of the pixel circuit illustrated in FIG. 9

In practice, in the present invention, the pixel circuit 142 may be formed in various configurations as illustrated in FIG. 10A and FIG. 10B. The pixel circuit 142 illustrated in FIG. 10A has two transistors M1 and M2 and one capacitor Cst, and the pixel circuit 142 illustrated in FIG. 10B has six transistors M1 to M6 and one capacitor Cst.

Herein, the pixel circuit 142 illustrated in FIG. 10B connects the driving transistor M1 in a diode form so that the threshold voltage of the driving transistor M1 is compensated. The present invention is to drive pixels 140 in a constant-voltage and constant-current system during a frame period, and may be applied to all kinds of pixels known in the art.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A method of driving an organic light emitting display, comprising:

supplying a data signal to pixels; and after the data signal is supplied, driving the pixels in a constant-voltage system during a first time period of a frame period and in a constant-current system during a second time period of the frame period, a second power source at a second voltage being supplied during the first time period in response to an external control signal, the second power source at a first voltage being supplied during the second time period in response to the external control signal, the second voltage being set to be higher than the first voltage, the second power source being output from an output unit, the external control signal being amplified by an inverter to be delivered to the output unit.

2. The method according to claim 1, the second time period being set to be wider than the first time period.

3. The method according to claim 1, each of the pixels including a driving transistor which controls current flowing from a first power source to a second power source through an organic light emitting diode, and the driving transistor being driven in a linear region during the first time period and the driving transistor being driven in a saturation region during the second time period.

4. An organic light emitting display, comprising:

a scan driving unit for driving scan lines;

a data driving unit for driving data lines;

pixels positioned at a cross section of the scan lines and the data lines, and controlling the amount of current flowing from a first power source to a second power source through an organic light emitting diode; and a power supply that generates the first power source and the second power source;

each of the pixels being driven in a constant-voltage system during a first time period of a frame, and being driven in a constant-current system during a second time period of the frame, the power supply supplying the second power source at a second voltage during the first time period, and supplying the second power source at a first voltage during the second time period in response to an external control signal, the second voltage being set to be higher than the first voltage, the power supply including an output unit to output the second power source at one of the second voltage and the first voltage in response to the external control signal, the power supply further including an inverter unit that amplifies the external control signal to deliver the external control signal to the output unit.

5. The organic light emitting display according to claim 4, the second time period being set to be wider than the first time period.

6. The organic light emitting display according to claim 4, each of the pixels including a driving transistor which controls current flowing from a first power source to a second power source through the organic light emitting diode, and the driving transistor being driven in a linear region during the first time period and the driving transistor being driven in a saturation region during the second time period.

7. The organic light emitting display according to claim 4, the power supply commonly supplying the pixels with the second voltage.

8. The organic light emitting display according to claim 4, the power supply supplying the second power source to the pixels by horizontal lines.

9. The organic light emitting display according to claim 4, the pixels being driven in the constant-voltage and constant-current systems after the data signal is supplied to each of the pixels.

10. An organic light emitting display, comprising:

a scan driving unit for driving scan lines;

a data driving unit for driving data lines;

pixels positioned at a cross section of the scan lines and the data lines, and controlling the amount of current flowing from a first power source to a second power source through an organic light emitting diode; and a power supply that generates the first power source and the second power source;

each of the pixels being driven in a constant-voltage system during a first time period of a frame, and being driven in a constant-current system during a second time period of the frame, wherein the power supply supplies the second power source at a second voltage during the first time period, and supplying the second power source at a first voltage during the second time period in response to an external control signal, wherein the power supply includes an output unit to output the second power source at one of the second voltage and the first voltage in response to the control signal, and wherein the power supply further includes an inverter unit that amplifies the control signal to deliver it to the output unit.

11. The organic light emitting display according to claim 10, the second time period being set to be wider than the first time period.

12. The organic light emitting display according to claim 10, each of the pixels including a driving transistor which controls current flowing from a first power source to a second power source through the organic light emitting diode, and the driving transistor being driven in a linear region during the first time period and the driving transistor being driven in a saturation region during the second time period.

13. The organic light emitting display according to claim 10, the pixels being driven in the constant-voltage and constant-current systems after the data signal is supplied to each of the pixels.

* * * * *